United States Patent [19]

Robertson

[11] 3,986,555

[45] Oct. 19, 1976

[54] APPARATUS FOR PROVIDING A PACKAGED CORE

[75] Inventor: William Robertson, Newcastle-upon-Tyne, England

[73] Assignee: Dresser Industries, Inc., Dallas, Tex.

[22] Filed: Apr. 10, 1975

[21] Appl. No.: 566,866

[52] U.S. Cl. ..... 166/246; 166/249

[51] Int. Cl.[2] ..... E21B 9/20; E21B 25/00

[58] Field of Search ..... 175/244, 245, 246, 247, 175/248, 249, 44, 46, 239, 240, 236

[56] References Cited

UNITED STATES PATENTS

| | | | |
|---|---|---|---|
| 2,779,195 | 1/1957 | Simon | 175/249 X |
| 2,857,138 | 10/1958 | Svendsen et al. | 175/246 X |
| 2,927,776 | 3/1960 | Hildebrandt et al. | 175/245 X |
| 3,104,725 | 9/1963 | Buchele | 175/244 |
| 3,285,354 | 11/1966 | Sanders et al. | 175/245 X |
| 3,561,546 | 2/1971 | Craig | 175/245 X |
| 3,565,192 | 2/1971 | McLarty | 175/246 |
| 3,621,924 | 11/1971 | Lebourg | 175/245 X |

*Primary Examiner*—Stephen J. Novosad
*Attorney, Agent, or Firm*—Eddie E. Scott

[57] ABSTRACT

A packaged core is obtained using a conventional core barrel system. A lining is provided in the core sample container of the core barrel. The core barrel is connected to a drill string extending into a borehole. As the drill string is rotated, the core sample moves into the sample container and inside of the lining. When the core barrel arrives at the surface, the sample core may be removed from the core barrel packaged in the lining. The core may be examined on site or the ends of the lining closed and the core completely packaged for shipment to the laboratory.

1 Claim, 5 Drawing Figures

APPARATUS FOR PROVIDING A PACKAGED CORE

BACKGROUND OF THE INVENTION

The present invention relates to the art of earth boring and, more particularly, to an improved core drilling and recovery system.

It is common practice to take samples or cores of earth formations to obtain geological information. The cores are obtained by the use of a hollow rotary drill string or drill stem having a core bit at the lower end and a core barrel positioned within the hollow rotary drill string adjacent the core bit. When the drill string is withdrawn from the borehole, the core may be removed from the core barrel for analysis. It is also known to use a retractable core barrel to obtain the core sample without removing the drill string from the borehole. The retractable core barrel is locked in cooperative relation with the core bit until the core sample is taken. At that time, a retriever connected to a wire line is utilized to remove the core barrel by drawing it out of the drill string.

One of the major problems in obtaining an undisturbed core sample occurs after the drilling operation has been completed and the core sample is to be removed from the core barrel for measuring, inspection, sampling and laboratory testing. When using the conventional double-tube core barrel, the core sample must be slid or pushed from the inner tube of the core barrel and laid out in core boxes. When drilling soft or unconsolidated formations, extruding the core sample from the inner tube in substantially every instance either compacts the core sample or causes it to collapse. The transferring of the core sample to core boxes simply creates another potential source for damage or core sample loss. If the core is from a formation which tends to swell once the core is in the inner tube, for example in fire clay formations, great difficulty is experienced in removing the core sample from the inner tube. Mechanical or hydraulic core extruding devices have been employed. They apply a considerable axial load to the core to force it from the inner tube and, as a consequence, result in damage to the core sample. It will be appreciated that a need exists for a low-cost, simple and efficient system for obtaining undisturbed core samples. Such a system is especially needed for use in soft, friable formations, particularly coal measures.

DESCRIPTION OF PRIOR ART

In U.S. Pat. No. 3,739,865 to Tiete O. Wolda, assigned to Boyles Industries, Ltd., patented June 19, 1973, a wireline core barrel with resilient latch fingers is shown. This patent shows a wireline core barrel system that may be used when drilling up or down, including drilling at various inclinations. Latch fingers that are flexible and resilient are rigidly connected to the core barrel body. The latch fingers are moved into and retracted from a latch seat by a movable actuator that bends the latch fingers in a first actuator position and allows them to spring back into shape in a second actuator position. The core barrel system provides a predetermined pressure signal indicating latching and blocks fluid flow until the core barrel is properly latched.

A triple-tube core barrel system is believed to be currently being sold by Triefus Industries (Australia) Pty. Ltd., 34–46 Oxley Street, Crows Nest, Sydney N.S.W. 2065 Australia. This Triefus triple-tube core barrel system is in use contemporaneously with core barrel systems constructed in accordance with the present invention. However, applicant does not know the date the Triefus triple-tube core barrel system was first known or described in a printed publication or the date it was first in public use or on sale in the United States. There are two basic types of Triefus triple-tube core barrels in use, the standard and retractor types. The retractor type is especially suited for coring very soft formations where the core may be washed away by any excess jetting action while circulating. In general, the triple-tube core barrel does not eliminate many of the problems previously discussed. The triple-tube core barrel, in general, consists of a third steel tube, split into two halves lengthwise, inserted into the inner tube of the core barrel. When the core run has been completed and the inner tube full, the third split tube containing the core sample can be extruded from the inner tube. The top half of the tube can be removed and the core lying in the bottom half measured and sampled on site. However, if the core is required for laboratory testing, it has then to be transferred to core boxes and, in doing so, is disturbed. The cost of manufacturing this thin-wall tube, some ten feet long and split in half lengthwise is very high. Some triple-tube core barrels have the inside of the split third tube chrome plated to provide a very smooth surface, reduce friction and allow the core to pass in more freely. This process again adds tremendous cost to the core barrel.

SUMMARY OF THE INVENTION

The present invention provides a low-cost, simple and effective system for obtaining undisturbed core samples. A lining is provided for the core sample container of a core barrel. The core barrel is to be connected to a drill string extending into a borehole. A core bit is connected to the lower end of the drill string. The core barrel includes a core barrel body with a core sample container connected to the core barrel body. The core sample container is positioned proximate the core bit to receive a core as it is drilled by the bit. A lining is located within the core sample container for receiving the core sample as it passes from the core bit. Once the core barrel is returned to the surface, the core sample may be removed from the core sample container packaged in the lining. The present invention may be used with either standard core barrels or retractable core barrels. The above and other features and advantages of the present invention will become apparent from a consideration of the following detailed description of the invention when taken in conjunction with the accompanying drawings.

DETAILED DESCRIPTION OF THE INVENTION

Figure 1:
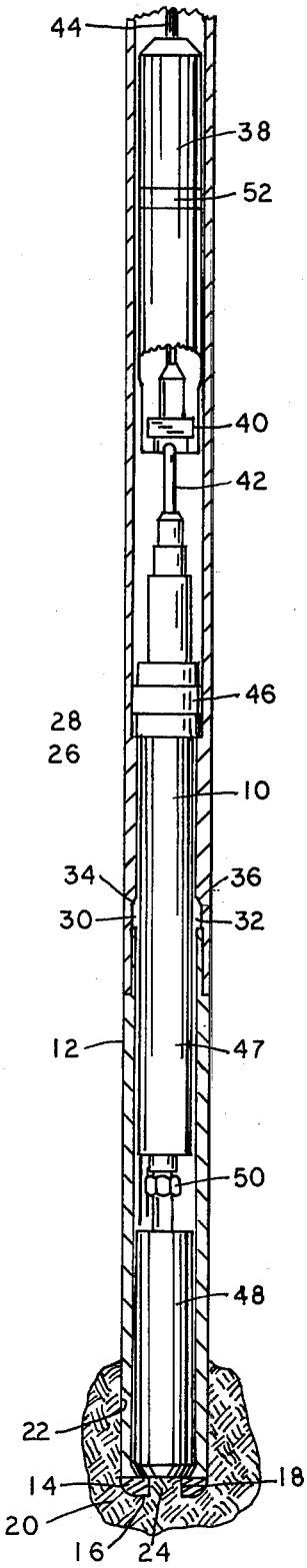
FIG. 1 is an elevational view of a retractable wireline core barrel system showing a portion of a drill string with a coring bit attached. A core barrel is positioned in the drill string for receiving a core sample. A retriever for withdrawing the core barrel from the drill string is shown above the core barrel.

Referring now to FIG. 1, a core barrel generally designated by the reference number 10 is shown positioned within a rotary drill string 12. The rotary drill string 12 consists of a series of sections of hollow drill pipe connected together to form a drill string. For example, the drill string 12 may be made up of a series of sections of threaded drill pipe connected together end to end. A coring bit 14 is connected to the lower end of the rotary drill string 12. The coring bit 14 includes a circular cutting face 16 and a central opening 18. The cutting face 16 may include any of the cutting structures known in the prior art, such as diamonds impregnated in a metal matrix. As the drill string 12 and the core bit 14 are rotated, the cutting face 16 serves to disintegrate the formation 20 and form a borehole 22. The central opening 18 in the core bit 14 allows a core 24 to build up during the drilling operation. In order to obtain geological information about the formation 20, a section of the core 24 is withdrawn from the borehole 22 using the wireline core barrel system of the present invention.

The core drilling operation may be conducted either up or down from the horizontal including drilling at any inclination. For example, the core drilling operation may be conducted from the surface by drilling downward into the formations, or the core drilling operation may be conducted upward into the formations above a mine drift. Rotary drilling equipment (not shown) is positioned at the face of the formation through which the drilling operation is to proceed. The rotary drilling equipment supplies both rotary and thrust forces to the drill string and may consist of any of the various rotary drilling machines known in the prior art. Most drilling operations require a fluid circulation system for cooling the bit and flushing the cuttings and drilling debris from the borehole. Such a fluid circulation system may include a hydraulic pump (not shown) connected to the drill string 12. The hydraulic pump circulates drilling fluid through the interior of the drill string 12, across the face 16 of the core bit 14 and upward in the annulus between the borehole wall and the exterior of the drill string.

In order to obtain a sample of the formations 20, the core barrel 10 is positioned within the drill string 12 adjacent the coring bit 14. When core drilling in dry holes, the core barrel 10 is lowered into position using the force of gravity and when core drilling in wet holes, core barrel 10 is pumped into position using the drilling fluid. The core barrel 10 is moved toward the bit end of drill string 12 until it reaches a landing shoulder 26 on the drill string 12. A complementary landing shoulder 28 on core barrel 10 contacts the landing shoulder 26 on the drill string preventing further downward movement and suspending the core barrel 10 in proper position for receiving the core 24. After the core barrel 10 reaches the coring position, it is latched firmly into place by latches 30 and 32 that engage latch seats 34 and 36 on the drill string 12. When the core barrel 10 has received the desired core sample, it must be withdrawn from the borehole 22. This is accomplished by a retriever 38 that is transported through the drill string 12 until it reaches core barrel 10. A gripping element 40 on retriever 38 engages a spear connection 42 on core barrel 10. The latches 30 and 32 are disengaged from latch seats 34 and 36 and the core barrel 10 and retriever 38 are withdrawn from the drill string by a cable 44 connected to retriever 38 and a hoist (not shown).

The core barrel 10 includes a packing rubber 46 that gives the core barrel an enlarged diameter to form a fluid seal between the drill string 12 and core barrel 10. The core barrel 10 may then be pumped into position by fluid pressure from the drilling equipment. Once the core barrel is latched in place and firmly connected to the drill string 12, the drilling fluid must be allowed to bypass the core barrel 10 in order to cool the core bit 14 and flush drill cuttings and debris from the borehole.

Since the upper portion 47 of core barrel 10 is firmly connected with the drill string, it will rotate when the drill string is rotated. To prevent core sample from being unnecessarily disturbed, the core sample container 48 must be prevented from rotating; therefore, a swivel 50 is provided to connect the core sample container 48 and the upper portion 47 of core barrel 10.

Since the retriever 38 is generally pumped into position in the same manner as the core barrel 10, the retriever 38 contains a seal element 52 similar to the packing rubber 46 on core barrel 10. This seal element 52 as well as the packing rubber 46 must be bypassed by the fluid standing in the drill string when the retriever 38 and the core barrel 10 are being withdrawn from the drill spring 12. Otherwise, the entire stand of fluid in the drill string would have to be withdrawn before the core sample could be obtained. Fluid channels are opened through the retriever 38 and core barrel 10 by the pulling force of cable 44.

One of the major problems associated with obtaining an undisturbed core sample occurs after the drilling operation has been completed and the core is to be removed from the inner tube. When using the conventional double-tube core barrel, the core sample must be slid or pushed from the inner tube and laid out in core boxes. When drilling soft formations, extruding from the inner tube in substantially all instances either compacts the core sample or causes its collapse. The transferring of the core sample to core boxes is simply another potential source for damage or loss of the core sample. If the core is from a formation which tends to swell once it is in the inner tube, for example fire clay, great difficulty is experienced in removing the core sample from the inner tube. Mechanical or hydraulic core extruding devices are generally employed. They apply a considerable axial load to the core to force it from the inner tube. This generally results in damage to the core.

The present invention provides a transparent plastic tube that is inserted in the inner tube of a double-tube core barrel. The lower end of the plastic tube is protected by a steel retaining clip which prevents damage to the edge of the plastic tube by the entry of the core sample. The upper end of the plastic tube is terminated with a steel piston which is used to push the plastic tube containing the core sample from the inner tube. The fit of the plastic tube within the inner tube is arranged so that the plastic tube, when it is filled with the sample core, may be slid easily from the inner tube. This eliminates the use of expensive mechanical or hydraulic core extruding devices. Such devices inevitably result in damage to the core sample. Once the packaged core has been removed from the inner tube, the core sample may be viewed and measured in a completely undisturbed state. By sealing the ends of the plastic tube, the packaged core may be transported from the site, thereby eliminating the use of wooden or metal core boxes. If necessary, the plastic tube may be split by a sharp knife and the core viewed and sampled on site. The split may then be sealed by tape and the packaged core transported elsewhere. If the plastic tubes are not damaged they may be reused after cleaning.

The present invention provides a system of obtaining undisturbed core samples. The use of core boxes is eliminated by the present invention. The present invention eliminates the use of mechanical or hydraulic core extruding devices. The transportation of cores from the drill site to the laboratory is simplified. The plastic lining tubes are reusable in most instances. The present invention is much more economical than the use of the very expensive triple-tube core barrel. The core barrel of the present invention may be used with either water or air systems. The plastic lining tube of the present invention has a very smooth bore, thereby assisting passage of the core during the drilling operation. In broken formations, the cores produced generally have sharp edges. The present invention prevents such sharp edges from tearing or damaging the plastic tube.

Figure 2:
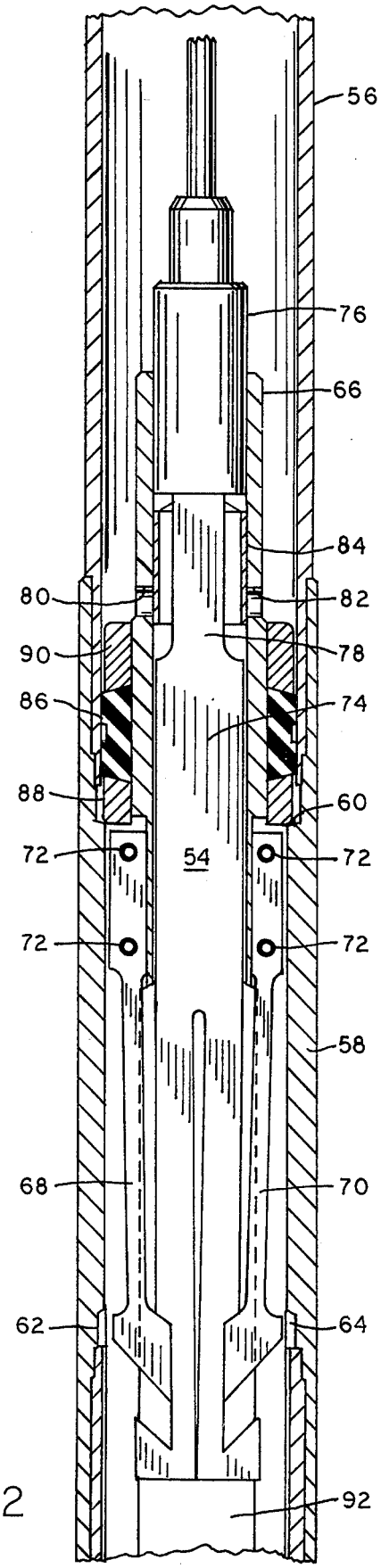
FIG. 2 shows the upper portion of a core barrel illustrating the present invention.
Figure 3:
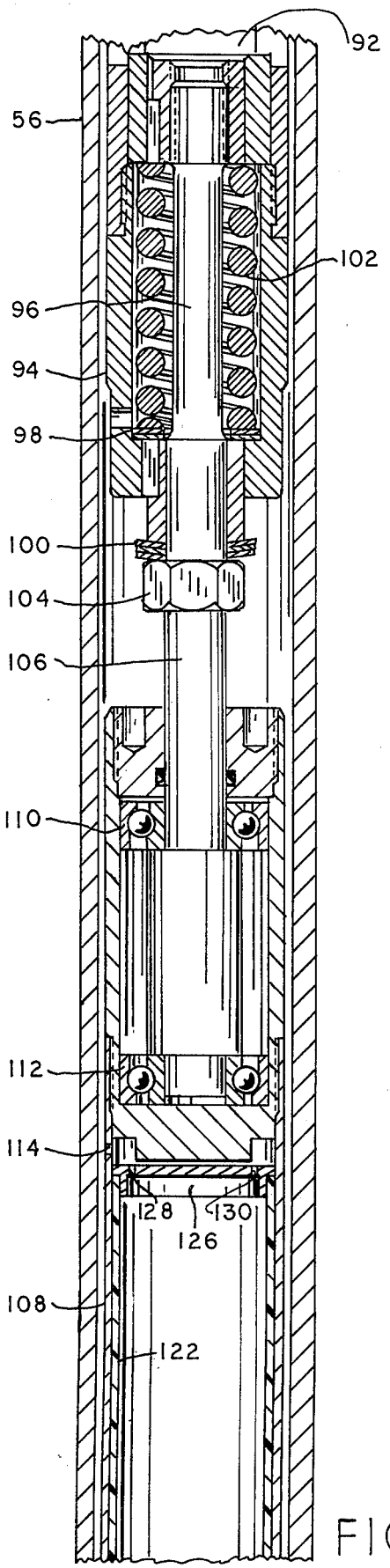
FIG. 3 shows the middle portion of the core barrel shown in FIG. 2.
Figure 4:
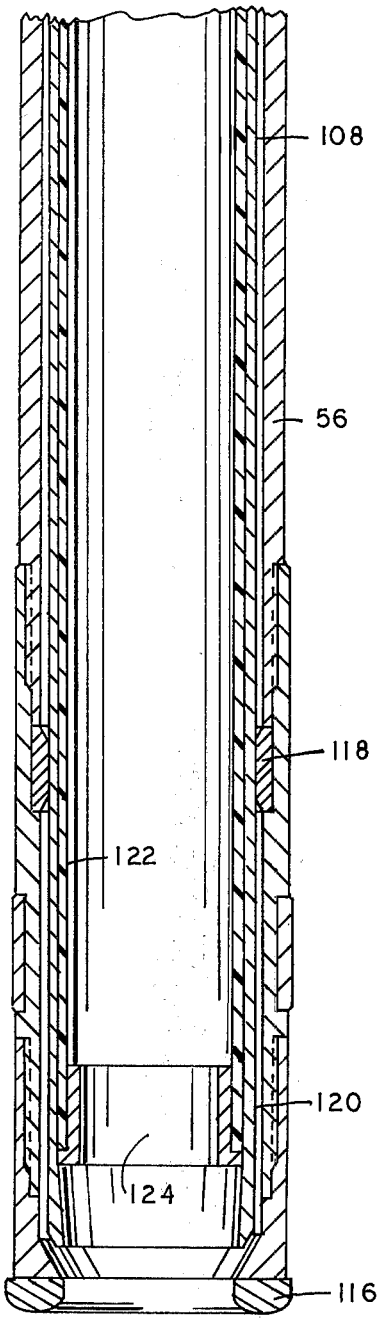
FIG. 4 shows the lower portion of the core barrel shown in FIGS. 2 and 3.

Referring now to FIG. 2, the upper portion of a core barrel 54 constructed in accordance with the present invention is shown, with the entire core barrel 54 being shown by a combination of FIGS. 2, 3 and 4. When FIGS. 2, 3 and 4 are arranged one above the other, with FIG. 2 being the top figure and FIG. 4 being the bottom figure, the complete core barrel 54 is shown. Core barrel 54 easily fits within a hollow rotary drill string 56 that includes a latch and a landing shoulder section 58. The latch and the landing shoulder section 58 is similar to the other sections of the drill string but include an internal shoulder 60 and a pair of latch seats 62 and 64.

The upper portion of core barrel 54 consists of a cylindrical tubular housing 66 somewhat smaller in diameter than the interior of drill string 56. A pair of latch fingers 68 and 70 are rigidly affixed to the tubular housing 66 by four mounting pins 72. The latch fingers 68 and 70 are constructed of a flexible and resilient material such as spring steel. The latch fingers 68 and 70 are shown in their unflexed position wherein the core barrel 54 may be transported through the drill string. An actuator 74 is positioned within the tubular housing 66 and adapted to slide therein from a first position wherein the latch fingers 68 and 70 fit in recesses in the side of actuator 74 to a second position wherein the latch fingers are forced outward by the actuator 74 into a stressed position.

The upper end of the actuator 74 is a solid cylinder that fits within the tubular housing 66 and closes its upper end. The upper end 76 of actuator 74 slides freely within the tubular housing 66 but prevents any fluid within the drill string 56 from entering the tubular housing. The lower section 78 of actuator 74 has a rectangular cross section thereby leaving a fluid passageway through the entire lower portion of the core barrel 54. A pair of holes 80 and 82 are located in the side of tubular housing 66 to allow fluid from within the drill string 56 to flow freely through the core barrel 54 unless they are blocked by valve element 84. The valve element 84 is affixed to actuator 74 and moves with actuator 74 to block or unblock the holes 80 and 82. When in the position shown in FIGS. 2, 3 and 4 the actuator 74 and valve element 84 block the fluid passage; however, they may be moved either up or down to unblock the holes 80 and 82. The angular ends of the latch fingers 68 and 70 and the hook-shaped ends of actuator 74 cooperate to insure that the latch fingers 68 and 70 will be retracted even if they are broken.

A ring-shaped packing rubber 86 is mounted on the exterior of tubular housing 66 and provides the core barrel 54 with an enlarged diameter to form a fluid seal with the wall of the drill string 56. The extension of the packing rubber 86 may be adjusted by a backup ring 88 positioned below packing rubber 86 and a threaded packing nut 90 positioned above packing rubber 86. The packing rubber is squeezed between packing nut 90 and backup ring 88 and the amount of extension may be varied by adjusting the packing nut 90. The backup ring 88 forms a landing shoulder on core barrel 54 and, coupled with the packing rubber 86 and packing nut 90, provides a cushioning structure when the core barrel 54 lands upon landing shoulder 60 on the drill string.

A pair of elongated extensions 92 of the tubular housing 66 (one on each side of actuator 74) connect the upper portion of the core barrel with the spring and spindle housing 94 shown in FIG. 3. Positioned within the spring and spindle housing 94 and adapted to slide therein is an elongated spindle 96. A spindle retainer 98 is affixed to spindle 96 at a point inside of housing 94, and a second spindle retainer 100 is affixed to spindle 96 some distance below retainer 98 and outside of housing 94. This allows the spindle 96 to move up and down within certain limits established by the retainers 98 and 100. A spring 102 is positioned within housing 94 surrounding spindle 96, thereby urging the spindle 96 to its lowest position. The length of spindle 96 may be adjusted by a block nut 104 that engages the threaded lower portion 106 of spindle 96. A core sample container 108 is rotatably connected to the lower portion 106 of spindle 96 by bearings 110 and 112. Thus, core sample container 108 rotates freely relative to the upper portion of the core barrel 54 and upward pressure on the core sample container 108 will produce upward movement of spindle 96 acting against the force of spring 102. A hole 114 in the upper end of core sample container 108 allows fluid to exit from the container 108 as the container is filled with the core sample.

Referring now to FIG. 4, the core sample container 108 is shown positioned adjacent the coring bit 116. A stabilizer ring 118 holds the core sample container 108 firmly in position to receive the core as it is drilled. A core lifter 120 is connected to the lower end of core sample container 108 and serves to retain the core sample within container 108 throughout the core sampling operation. A transparent plastic lining 122 is positioned within core sample container 108. The lower end of the plastic liner tube 122 is engaged by a steel retaining clip 124 which prevents damage to the edge of the plastic tube 122 during the entry of the core. The steel retaining clip 124 has a lower annular portion that extends around the lower end of the core sample container 108. The upper end of the plastic tube 122 is engaged by a steel piston 126 that may be used to push the plastic tube 122 containing the core from the inner tube 108. A pair of holes 128 and 130 extend through the steel piston 126. The holes 128 and 130 in combination with the hole 114 allow the flow of fluid into or out of the core sample container 108. The fit of the plastic tube 122 in the inner tube 108 is arranged so that the plastic tube 122 when it is filled with the core may be easily slid from the inner tube. Once the packaged core has been removed from the inner tube, the core may be viewed and measured at the site in a completely undisturbed state. The transparent plastic tube 122 provides a clear view of the sample. By sealing the ends of the tube 122 the core sample may be transported from the site without the use of core boxes. If required, the plastic tube may be split and the core viewed and sampled at the site. The split may then be sealed by tape and the packaged core transported to the laboratory. The plastic tube 122 may be reused after cleaning if it is not damaged.

The structural details of one embodiment of a core sampling system constructed in accordance with the present invention having been described, the operation of the core barrel 54 will now be considered with reference to FIGS. 2, 3 and 4, which show the core barrel 54 positioned in the drill string 56. The plastic lining tube 122 is inserted into the core sample container 108. The upper steel piston 126 and lower retaining clip 124 form an interference fit with the tube 122. The tube 122 is sufficiently rigid that it can easily be slid into the core sample container 108. The core barrel 54 is placed inside rotary drill string 56 and moved into core receiving position adjacent the coring bit 116. In dry holes, the packing nut 90 is loosened to reduce the extension of packing rubber 86 and the core barrel 54 is lowered into position by a retriever that engages the elongated upper portion of actuator 74. Once the core barrel 54 reaches the coring position, the retriever disengages the spear point and is withdrawn from the drill string. In wet holes, packing nut 90 is tightened, thereby compressing packing rubber 86 and increasing its extension to provide a fluid seal between tubular housing 66 and the interior of the drill string 56. The core barrel 54 may then be pumped into position. It can be appreciated that the adjustability of the extension of the packing rubber 86 serves to compensate for wear of the packing rubber. In addition, the packing rubber 86 serves as a cushion to absorb shock when the core barrel 54 lands on landing shoulder 60. Since the backup ring is not affixed to the tubular housing 66, the shock from striking the landing shoulder 60 is transmitted from the backup ring 88 to the packing rubber 86.

When the core barrel 54 is being pumped into position, the latch fingers 68 and 70 are in a relaxed position away from the walls of the drill string with the valve element 84 blocking holes 80 and 82. When the actuator is in this position, the core barrel 54 completely blocks the drill string 56 and may be pumped into position. Once the core barrel 54 reaches the internal shoulder 60 on the drill string, the backup ring 88 will strike shoulder 60 and prevent further downward movement. Since the core barrel 54 completely blocks fluid flow through the drill string 56, additional pumping will cause a rapid buildup of pressure in the drill string 56. This buildup in pressure advises the operator that the core barrel is located adjacent the core bit 116. The fluid pressure will continue to rise until a sufficient force is applied to the exposed portions of the upper end of actuator 74 to force actuator 74 downward and overcome the resistance of latch fingers 62 and 64. Once the required pressure is reached, the force on actuator 74 moves latch fingers 68 and 70 outward into the latch seats 62 and 64. The amount of fluid pressure, i.e., the force on actuator 74, required to move latch fingers 68 and 70, is a function of the inclination of the actuator surface engaging the latch fingers and their material strength. Therefore, the core barrel system will provide a predetermined pressure signal indicating latching of the core barrel. If the latch fingers 68 and 70 do not latch in place, the pressure increases beyond the predetermined pressure signal value, and the operator knows that the core barrel has failed to latch in place. Once the latch fingers 68 and 70 have latched in place, the actuator 74 moves downward, opening holes 80 and 82 and allowing fluid in the drill string 56 to circulate through the core barrel during the core drilling operation. Consequently, there is little possibility of drilling when the core barrel is in the unlatched position.

With the core barrel 108 locked in the core receiving position adjacent the core bit 116, the core taking operation is ready to proceed. The drill string 56 is rotated and a core begins to build up through the center of core bit 116 and into the plastic tube 122 within the core container 108. The fluid in the core container 108 is forced upward and will exit through holes 128, 130 and 114 into the drill string 56. When the core container 108 is completely filled with a core or when core blocking occurs, an upward force is applied to core container 108. This upward force is transmitted through the steel piston 126 and spindle 96 to the lower portion 78 of actuator 74. Actuator 74 is moved upward until the valve element 84 is in a position blocking holes 80 and 82. This prevents fluid from bypassing core barrel 54, and a pressure signal is transmitted to the operator. The operator then knows it is time to retrieve the core barrel. Since formation conditions tend to vary, the amount of upward pressure on core container 108 during the core taking operation varies, and a downward force must be applied to spindle 96. This is accomplished by a spring 102 that acts against spindle 96. To compensate for changing formation positions, spindle 102 can be replaced with a spring of a selected strength to increase or decrease the resistance of upward movement of the spindle to suit the particular formation being cored.

The core barrel 54 is retrieved by the retriever being lowered until it grasps the elongated upper portion of actuator 74. An upward force is then applied to actuator 74 through the cable and retriever. Actuator 74 moves upward until the latch fingers 68 and 70 snap into their relaxed position in the recesses of actuator 74. Since resilient latch fingers 68 and 70 are in a stressed condition when they are in the latch seats 62 and 64, they tend to naturally snap back into their relaxed position. Should one or both of the latch fingers 68 and 70 be broken, they will be retracted by the hook-shaped lower end 78 of actuator 74 as actuator 74 is moved further upward. To avoid withdrawing the entire stand of fluid in the drill string 56 between the core barrel and the drilling equipment, a fluid channel must be opened through core barrel 54 to bypass fluid through tubular housing 66. This is accomplished by the actuator 74 continuing to move upward until the valve element 84 is above holes 80 and 82, thus unblocking the holes and forming a fluid passageway through core barrel 54. The actuator 74 continues to move upward until the hook-shaped lower end 78 contacts the angular ends of latch fingers 68 and 70. Force is then transmitted through latch fingers 68 and 70 to the entire core barrel 54, and it may be withdrawn from the drill string.

Once the core barrel 54 is at the surface, the core sample within plastic tube 122 is withdrawn from core sample container 108. The steel retaining clip 124 and steel piston 126 assure that the core sample will remain intact. The geologist at the site can view the core sample through the transparent plastic tube 122. If necessary, the plastic tube 122 may be split with a sharp knife and the actual core sample viewed or sampled on site. The split may then be repaired using tape and the packaged core transmitted to the laboratory. The retaining clip 124 and steel piston 126 are removed and the ends of the tube 122 are sealed. The packaged core is then in a condition to be transported to the laboratory. The core sample is not damaged, as it would be if it were necessary to extrude the core sample from the sample container 108 into a core box.

Figure 5:
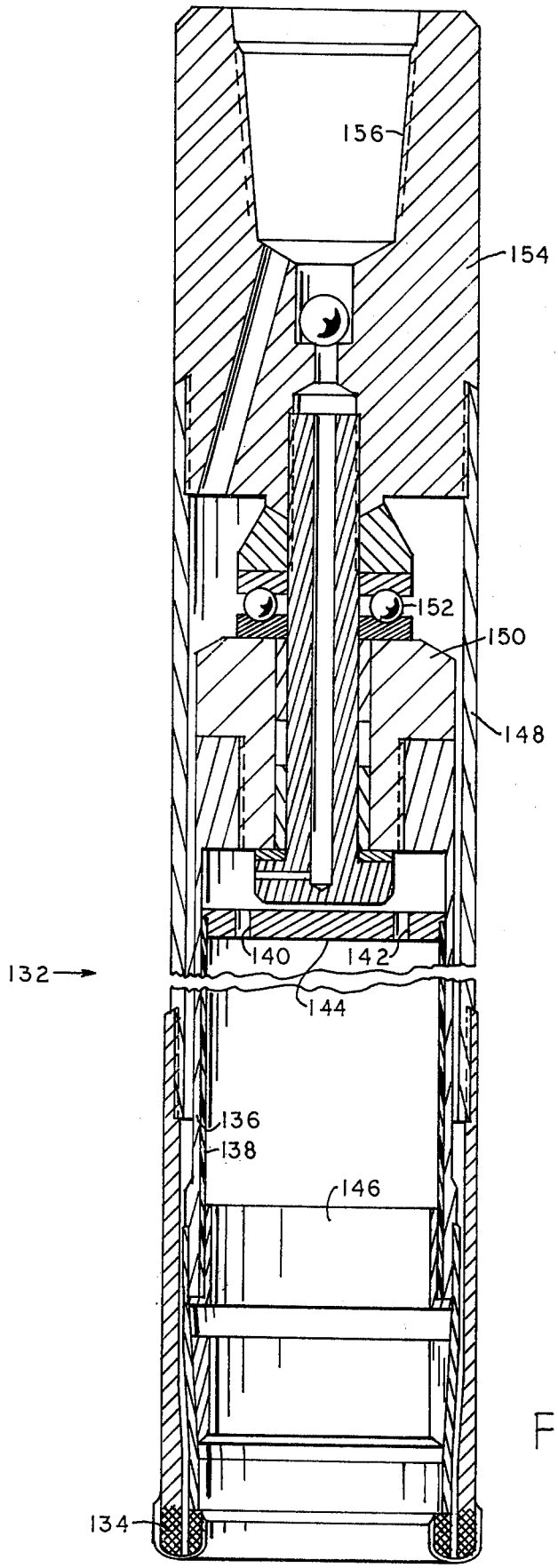
FIG. 5 shows an embodiment of a standard core barrel constructed in accordance with the present invention.

Referring now to FIG. 5, an embodiment of a standard core barrel 132 constructed in accordance with the present invention is shown. The core the series of threads 156. The core barrel 132 includes an upper body section 154 and a lower unnular body section 148 with a coring bit 134. A core sample container 136 is positioned within the lower annular body section 148 to receive a core at it is drilled by the coring bit section 148 to receive a core as it is drilled by the coring bit 134. The core sample container 136 is connected to a bearing housing 152. The core sample container 136 does not rotate relative to the core being drilled; therefore, the upper body section 154 rotates relative to the core sample container. The ball bearings 152 facilitate this rotation.

The core sample container 136 is shown positioned adjacent the coring bit 134. A core lifter is connected to the lower end of core sample container 136 and serves to retain the core sample within container 136 throughout the core sampling operation. A transparent plastic lining 138 is positioned within core sample container 136. The lower end of the plastic liner tube 138 is engaged by a steel retaining clip 146 which prevents damage to the edge of the plastic tube 138 during the entry of the core. The steel retaining clip 146 has a lower annular portion that extends around the lower end of the core sample container 136. The upper end of the plastic tube 138 is engaged by a steel piston 144 that may be used to push the plastic tube 138 containing the core from the inner tube 136. A pair of holes 140 and 142 extend through the steel piston 144. The holes 140 and 142 in combination with a hole in core sample container 136 allow the flow of fluid into or out of the core sample container 136. The fit of the plastic tube 138 in the inner tube 136 is arranged so that the plastic tube 138 when it is filled with the core may be easily slid from the inner tube 136. Once the packaged core has been removed from the inner tube, the core may be viewed and measured at the site in a completely undisturbed state. By sealing the ends of the packaged core, it may be transported from the site without the use of core boxes. If required, the plastic tube may be slit and the core viewed and sampled at the site. The slit may then be sealed by tape and the packaged core transported to the laboratory. The plastic tube 138 may be reused after cleaning if it is not damaged.

The structural details of a second embodiment of a core barrel constructed in accordance with the present invention having been described, the operation of the core barrel 132 will now be considered with reference to FIG. 5. The transparent plastic tube 138 is inserted in the core sample container 136. The core barrel 132 is connected to the rotary drill string and moved into core receiving position. The drill string is rotated and a core begins to build up through the center of core bit 134 and into the plastic tube 138 within the core container 136. The fluid in the core container 136 is forced upward and will exit through holes 140 and 142. When the core container 136 is completely filled with a core, the drill string is withdrawn from the borehole.

Once the core barrel 132 reaches the surface, the core sample and plastic tube 138 are withdrawn from core sample container 136. The steel retaining clip 146 and steel piston 144 assure that the core sample will remain intact. The geologist at the site can view the core sample through the transparent plastic tube 138. If necessary, the plastic tube 138 may be slit with a sharp knife and the actual core sample viewed on site. The slit may then be repaired using tape and the packaged core transmitted to the laboratory. The retaining clip 146 and steel piston 144 are removed and the ends of the tube 138 are sealed. The packaged core is then in a condition to be transported to the laboratory. The core sample is not damaged, as it would be if it were necessary to extrude the core sample from the sample container 136 into a core box.

The embodiments of the invention in which an exclusive property or privilege is claimed are defined as follows:

1. In a system for obtaining a core sample of an earth formation that includes a drill string extending into a borehole in the earth formation, rotary drilling equipment for rotating said drill string, a coring bit connected to the lower end of said drill string, a fluid circulation system connected to said drill string for circulating drilling fluid through said drill string, a latch seat on said drill string and a retriever that may be transported through said drill string, a rectractable core barrel comprising:

a core barrel body adapted to fit within said drill string, said core barrel having a maximum diameter smaller than the diameter of said drill string;

a core sample container connected to said core barrel body with a lower end adapted to be positioned proximate said core bit and an upper end, said core sample container being smaller in diameter than the interior of said drill string;

at least one flexible and resilient latch finger, said finger having a portion rigidly affixed to said core barrel body and a latch portion adapted to fit in said latch seat wherein said flexible latch finger and said core barrel body have a maximum diameter that is smaller than the interior of said drill string when said latch finger is in an unflexed position;

a seal element mounted on said core barrel body that forms a fluid seal between said tubular core barrel body and said drill string;

at least one fluid passage through said tubular core barrel body;

actuator means responsive to pressure of the drilling fluid for moving the latch portion of said at least one latch finger into the latch seat when the pressure of the drilling fluid exceeds a predetermined value;

valve means connected to said actuator means for opening and closing said fluid passage;

a plastic lining in said core sample container;

an annular rigid element connected to said plastic lining proximate said lower end; and a rigid element connected to said plastic lining proximate said upper end.

* * * * *